US011149337B1

(12) United States Patent
Mason et al.

(10) Patent No.: US 11,149,337 B1
(45) Date of Patent: Oct. 19, 2021

(54) CONTINUOUS GALVANIZING APPARATUS AND PROCESS

(71) Applicant: Western Technologies, Inc., Tulsa, OK (US)

(72) Inventors: Christopher Stephen Mason, Tulsa, OK (US); Russell Wayne Patterson, Jenks, OK (US)

(73) Assignee: Western Technologies, Inc., Tulsa, OK (US)

( * ) Notice: Subject to any disclaimer, the term of this patent is extended or adjusted under 35 U.S.C. 154(b) by 107 days.

(21) Appl. No.: 15/955,389

(22) Filed: Apr. 17, 2018

Related U.S. Application Data

(60) Provisional application No. 62/486,593, filed on Apr. 18, 2017.

(51) Int. Cl.

| | |
|---|---|
| ***C23C 2/00*** | (2006.01) |
| ***C23C 2/38*** | (2006.01) |
| ***C23C 2/06*** | (2006.01) |
| ***C23C 2/18*** | (2006.01) |

(52) U.S. Cl.
CPC ..... *C23C 2/38* (2013.01); *C23C 2/003* (2013.01); *C23C 2/06* (2013.01); *C23C 2/185* (2013.01)

(58) Field of Classification Search
CPC .... C23C 2/38; C23C 2/18; C23C 2/06; C23C 2/003
See application file for complete search history.

(56) References Cited

U.S. PATENT DOCUMENTS

| | | | | |
|---|---|---|---|---|
| 2,294,750 A * | 9/1942 | Harris | C23C 2/38 427/300 |
| 3,281,918 A * | 11/1966 | Leib | B22D 11/00 29/33 S |
| 3,620,805 A | 11/1971 | Martin | |
| 3,877,975 A | 4/1975 | Raymond | |
| 3,956,537 A | 5/1976 | Raymond | |
| 4,082,869 A * | 4/1978 | Raymond | C23C 2/02 118/405 |

(Continued)

FOREIGN PATENT DOCUMENTS

| | | |
|---|---|---|
| CN | 203807541 U | 9/2014 |
| DE | 4105159 | 2/1991 |

(Continued)

OTHER PUBLICATIONS

Korean Intellectual Property Office; International Search Report and Written Opinion; dated Feb. 14, 2020.

*Primary Examiner* — Hai Y Zhang
(74) *Attorney, Agent, or Firm* — Head, Johnson, Kachigian & Wilkinson, PC

(57) ABSTRACT

A continuous galvanizing apparatus for rods and process therefor. The apparatus includes a liquid reservoir. A plurality of adjacent tubes each pass into, through, and out of the liquid reservoir. Each of the adjacent tubes has at least one opening within the liquid reservoir so the tubes are in fluid communication with the reservoir. A rod drive mechanism moves a plurality of adjacent rods into, through, and out of the plurality of adjacent tubes. A kettle is provided beneath both the liquid reservoir and beneath the tubes. At least one pump pumps liquid from the kettle to the liquid reservoir so that liquid is continuously cycled to the tubes.

5 Claims, 10 Drawing Sheets

(56) References Cited

U.S. PATENT DOCUMENTS

| | | | | |
|---|---|---|---|---|
| 4,165,401 | A * | 8/1979 | Burke | C02F 1/385 210/167.3 |
| 5,338,581 | A | 8/1994 | Delot | |
| 5,506,002 | A | 4/1996 | Maitra et al. | |
| 5,527,563 | A | 6/1996 | Unger et al. | |
| 2016/0312345 | A1 | 10/2016 | Zheng | |
| 2016/0319446 | A1 | 11/2016 | Zheng | |
| 2019/0002213 | A1 | 1/2019 | Decoster et al. | |

FOREIGN PATENT DOCUMENTS

| | | |
|---|---|---|
| DE | 4340838 | 11/1993 |
| FR | 2647814 | 12/1990 |
| GB | 1546635 | 5/1979 |
| KR | 1019970070250 | 9/2000 |
| KR | 1020010042341 | 12/2003 |
| KR | 1020100079953 | 2/2011 |
| WO | 9602684 | 2/1996 |

* cited by examiner

CONTINUOUS GALVANIZING APPARATUS AND PROCESS

CROSS REFERENCE

This application claims priority to and the benefit of U.S. Provisional Patent Application Ser. No. 62/486,593, filed Apr. 18, 2017, which is incorporated herein in its entirety by reference.

BACKGROUND OF THE INVENTION

1. Field of the Invention

The present invention relates to a continuous galvanizing apparatus for rods and a process therefor. In particular, the present invention is directed to a continuous galvanizing apparatus that can simultaneously galvanize multiple rebar rods continuously without any manual intervention.

2. Description of the Related Art

The process of galvanizing iron or steel has been known for over a century. A layer of zinc or alloyed zinc forms to the surface of the steel or iron.

Galvanization provides both barrier protection and corrosion resistance.

Hot-dip galvanization is known wherein a metal object is dipped into a liquid bath of the zinc. Upon cooling, the zinc forms a protective barrier coating and provides corrosion resistance. More recently, iron or steel materials have been hot-dipped in a continuous line. In addition, continuous galvanization of items has been performed by passing an item through a flooded trough.

Notwithstanding the foregoing, there remains a need for a continuous galvanizing process to simultaneously galvanize a number of items without manual intervention in a closed loop system.

There also remains a need to provide a continuous galvanizing process to simultaneously galvanize a plurality of rods from an initial input stage through preparation phases, through galvanizing stages, and through post galvanizing phases.

SUMMARY OF THE INVENTION

The present invention is directed to a continuous galvanizing apparatus and process. A liquid reservoir contains heated liquid zinc or heated liquid zinc and aluminum. A series of adjacent tubes passes through the liquid reservoir. Each of the adjacent tubes has an entry opening and has an opposed exit opening outside of the liquid reservoir and suspended above and on top of an open kettle.

Each of the adjacent tubes has at least one opening or slot so that each of the adjacent tubes is in fluid communication with the liquid reservoir.

The kettle acts as a storage container for the liquid zinc or zinc and aluminum. The kettle is heated by a heater to retain in a liquid condition. The liquid is continuously pumped from the kettle up into the liquid reservoir. The liquid in the reservoir will pass through the slots in each of the tubes so that the tubes are substantially filled with liquid. Liquid in the tubes thereafter moves from the open entry and open exit and falls by gravity back into the kettle where the process is repeated.

A rod drive mechanism includes a rod inserting mechanism and a rod extracting mechanism. The rod inserting mechanism includes a first motor which drives a roller or a series of rollers. A first cylinder or cylinders is in communication with pinch rollers to provide a clamping force on the rods.

The rod extracting mechanism includes at least a second motor which drives a roller or a series of rollers. A second cylinder or cylinders provides a clamping force to pinch rollers which engage the plurality of rods and assist in extracting the rods from the tubes.

A series of liquid pumps pump fluid from the kettle into the liquid reservoir so that liquid moves in a closed loop system from the kettle, to the liquid reservoir, into the series of tubes, and then back to the kettle.

A series of rebar or rods are, accordingly, simultaneously moved into, through, and out of the galvanizing apparatus.

The present invention is also directed to a continuous galvanizing process to simultaneously galvanize a plurality of rods from an initial input stage through preparation phases, through galvanizing stages, and through post-galvanizing phases.

DETAILED DESCRIPTION OF THE INVENTION

The embodiments discussed herein are merely illustrative of specific manners in which to make and use the invention and are not to be interpreted as limiting the scope.

While the invention has been described with a certain degree of particularity, it is to be noted that many modifications may be made in the details of the invention's construction and the arrangement of its components without departing from the scope of this disclosure. It is understood that the invention is not limited to the embodiments set forth herein for purposes of exemplification.

Figure 1:
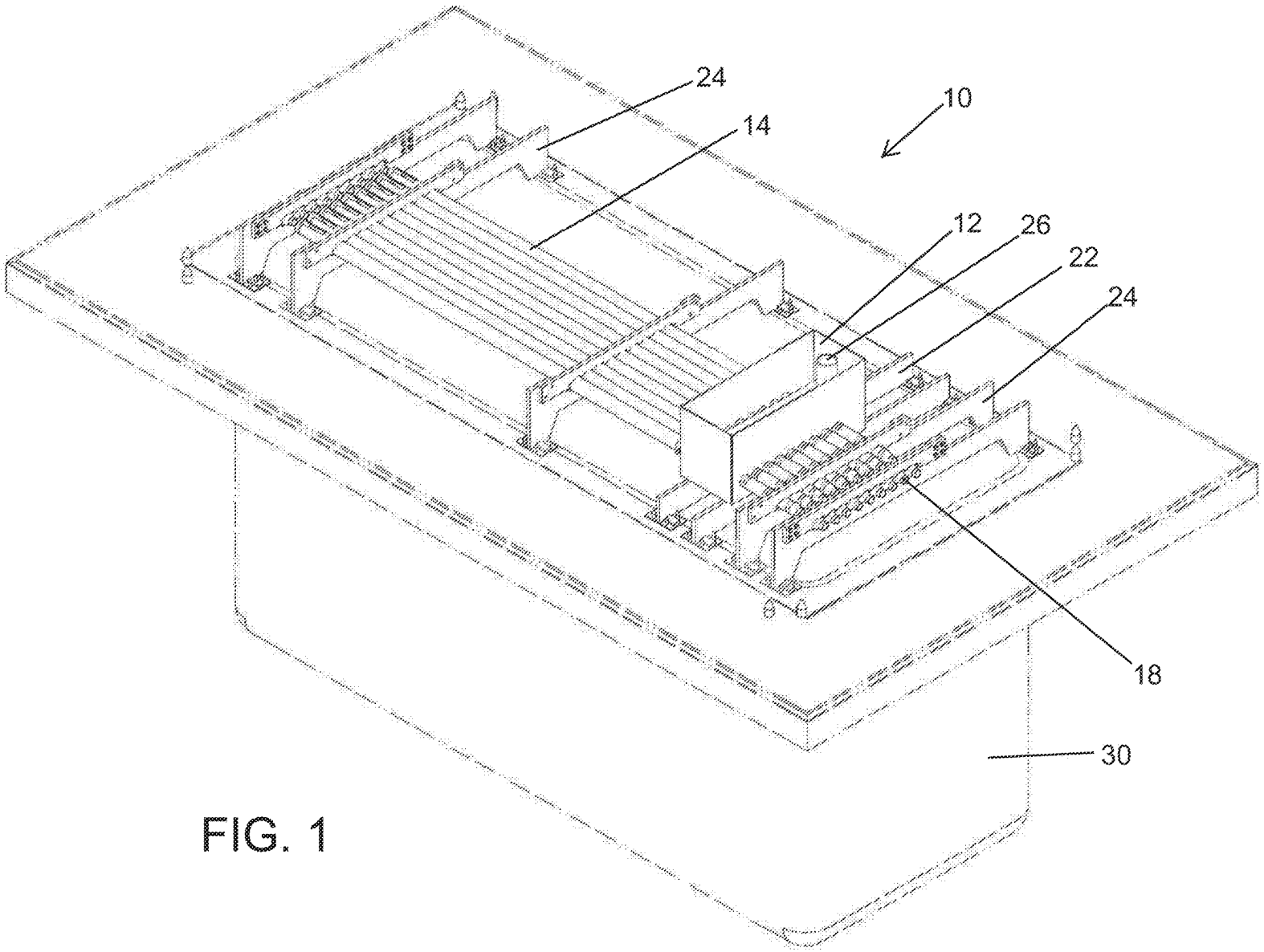
FIG. 1 illustrates a perspective view of a continuous galvanizing apparatus constructed in accordance with the present invention with portions of the components removed for ease of viewing.
Figure 2:
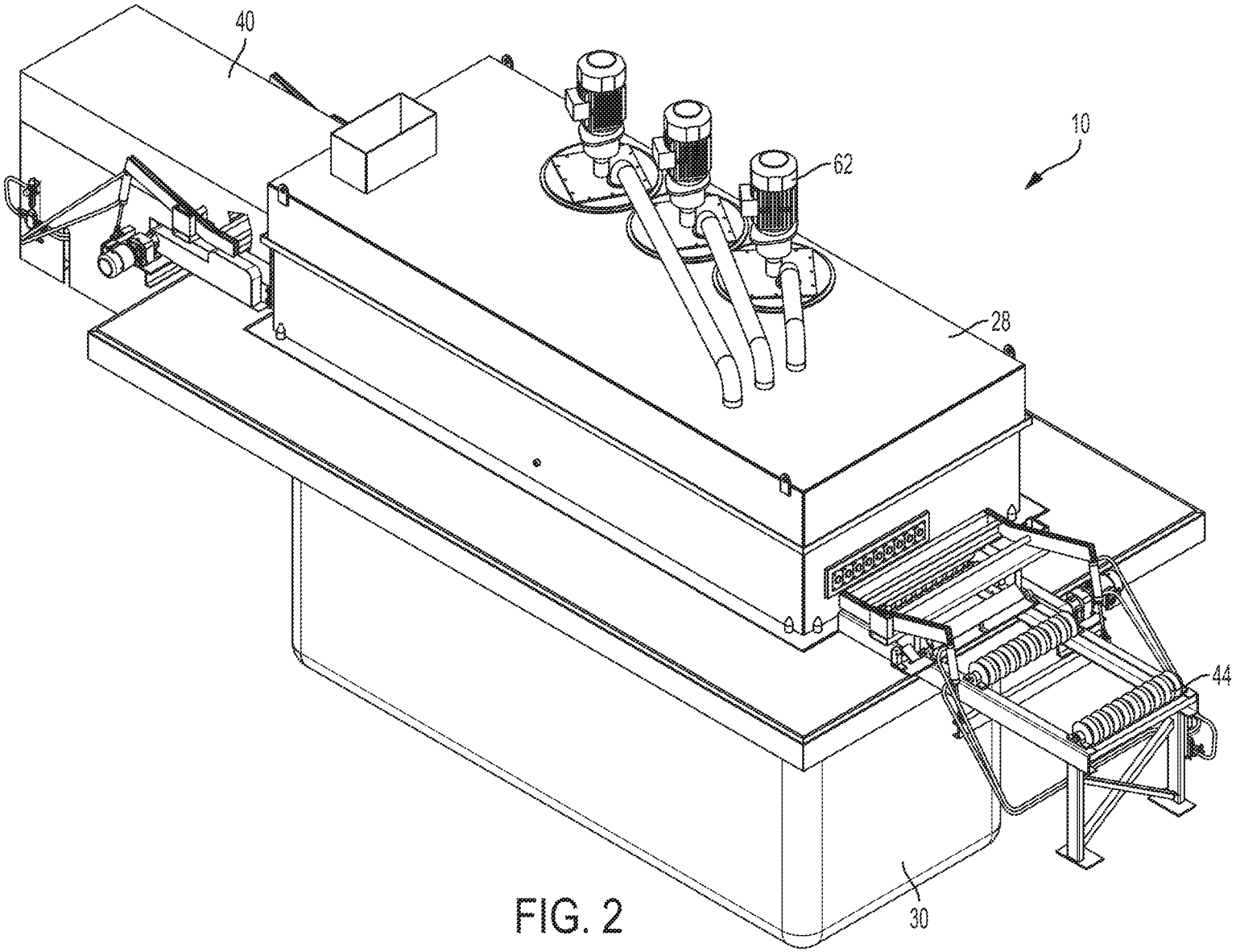
FIG. 2 illustrates a perspective view of the apparatus and FIG. 3 illustrates a side view of the continuous galvanizing apparatus.
Figure 3:
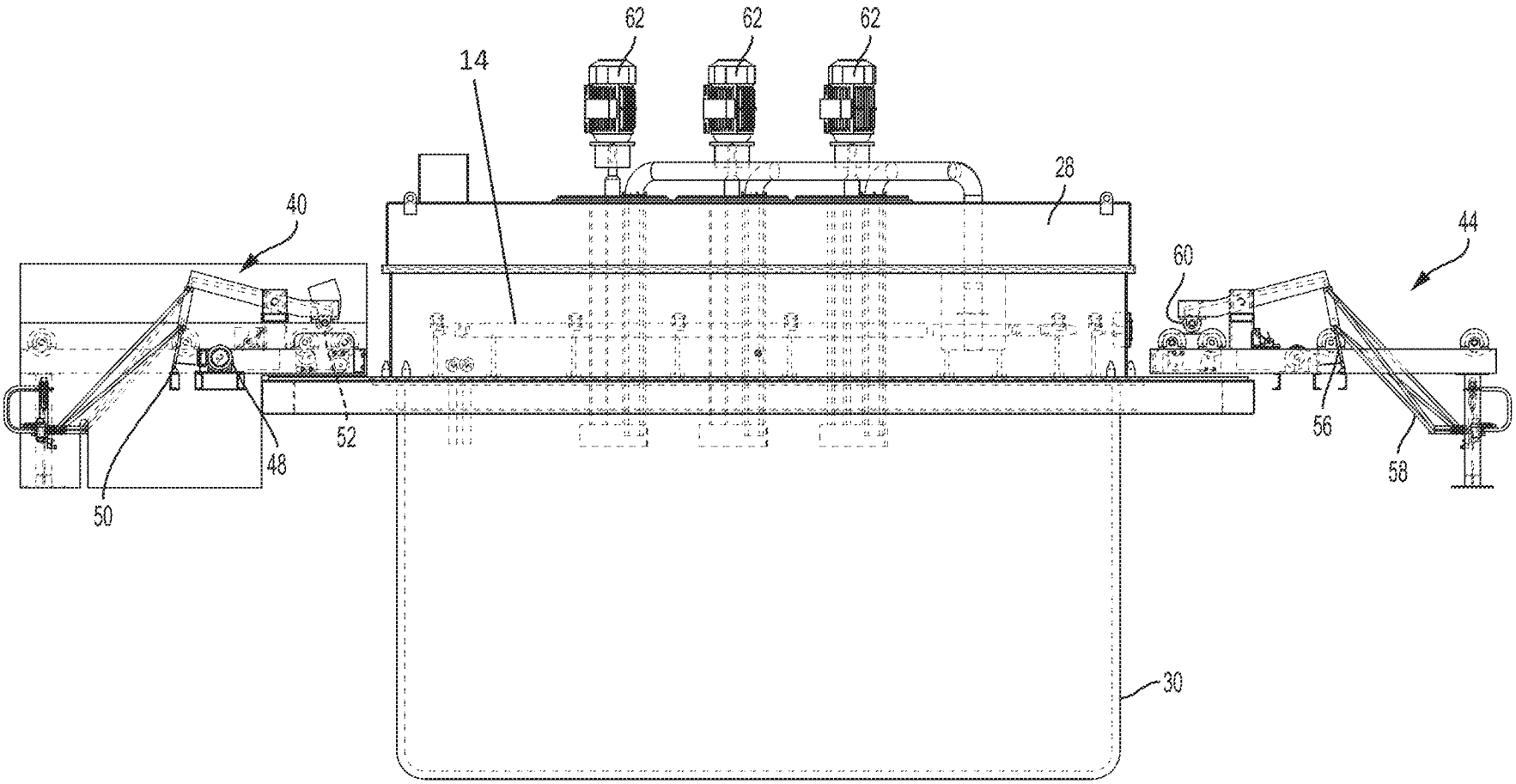

Referring to the drawings in detail, FIG. 1 is a perspective view of a continuous galvanizing apparatus 10 for rods with portions of the components removed for ease of viewing. FIG. 2 illustrates a perspective view of the continuous galvanizing apparatus 10. FIG. 3 illustrates a side view of the apparatus shown in FIG. 2.

The apparatus 10 includes a liquid reservoir 12 visible in FIG. 1. As will be described in detail, in one embodiment, the liquid reservoir 12 is a substantially elongated container which contains heated liquid zinc or heated liquid zinc and aluminum.

Passing through the liquid reservoir 12 are a plurality or series of adjacent tubes 14. In the embodiment shown, the tubes 14 are cylindrical and substantially parallel to each other, although other arrangements are possible. The tubes pass in a substantially transverse direction through the elongated liquid reservoir 12. In an alternate arrangement, the tubes 14 are substantially within the liquid reservoir with the exception of the entry and exit openings.

Each of the adjacent tubes 14 has an entry opening 16 (not visible in FIG. 1) and an opposed exit opening 18.

Each of the adjacent tubes 14 has at least one opening or slot. As best seen in the top view in FIG. 4, in the embodiment shown, each tube 14 has a series of slots 20 wherein the slots are within the liquid reservoir 12 so that each adjacent tube 14 is in fluid communication with the liquid reservoir 12.

Bracing or reservoir supports 22 support the liquid reservoir 12. One or more tube supports 24 support the adjacent tubes 14.

The reservoir supports 22 and the tube supports 24 support both the liquid reservoir 12 and the plurality of adjacent tubes 14 above an open top of a liquid kettle 30. Each of the entry openings 16 of the tubes 14 and each of the exit openings 18 of the tubes 14 are suspended above the open top of the liquid kettle 30. The kettle 30 acts as a storage container for the liquid zinc or zinc and aluminum. The kettle 30 is heated by a heater 32 in order to retain the zinc or zinc and aluminum in a molten or liquid condition.

The liquid is continuously pumped from the kettle 30 up into the liquid reservoir 12. Liquid in the reservoir 12 will pass through the various slots 20 into each of the tubes 14 so that the tubes are substantially filled with liquid. As both the entry openings 16 and the exit openings 18 are not closed, liquid in the tubes 14 will move from the tubes 14 and fall by gravity from the openings back into the kettle 30 where the process is repeated in a closed loop system.

The liquid reservoir 12 also includes an overflow protection tube 26 which has an open bottom. In the event that liquid in the reservoir exceeds a certain level, it passes into the tube 26 and back to the kettle 30. Accordingly, the level of liquid in the liquid reservoir will not exceed a certain level.

FIGS. 2 and 3 show a fume canopy 28 on top of the open kettle 30, the liquid reservoir 12 and the tubes 14 for retention and collection of gases. A ventilation system (not shown) may be used to exhaust the gases.

Figure 4:
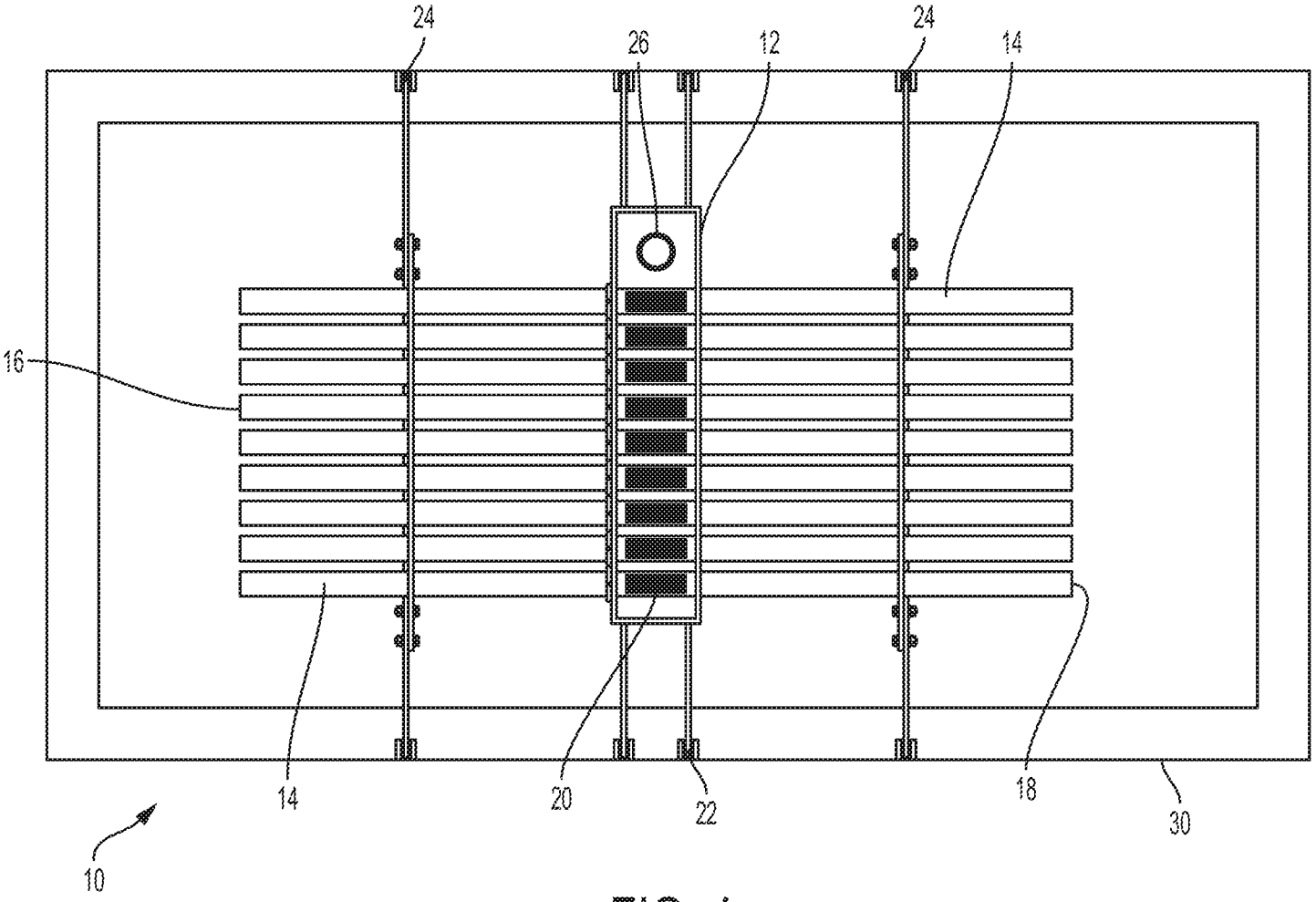
FIG. 4 illustrates a top view of the continuous galvanizing apparatus.

FIG. 4 illustrates a top view of the apparatus 10 with the fume canopy 28 removed for ease of viewing.

As will be explained in detail, each of the plurality of adjacent tubes 14 has a length shorter than the rods which are subject to the galvanization process.

A rod drive mechanism moves a plurality of rods into the adjacent tubes 14, through the liquid reservoir 12, and out of the adjacent tubes 14.

In one non-limiting embodiment, the rod drive mechanism includes a rod inserting mechanism 40 and a rod extracting mechanism 44. As seen in FIGS. 2 and 3, the rod inserting mechanism 40 is covered by a shroud to prevent escape of gases, while the rod extracting mechanism 44 is shown with a cover removed for ease of viewing. In operation, each would be covered with a shroud for retention and collection of gases.

The rod inserting mechanism 40 includes a first motor 48 which drives a roller or rollers. A first cylinder or cylinders 50 moves a roller or plurality of pinch rollers 52 to provide a clamping force on the rods. The cylinder 50 may be a pneumatic cylinder or another type and has an extending ram. The pinch rollers 52 engage a plurality of rods (not shown) and assist to insert the rebar or rods into the adjacent tubes 14 (seen in dashed lines in FIG. 3).

Likewise, the rod extracting mechanism 44 includes at least a second motor 56 which drives a roller or rollers. A second cylinder or cylinders 58 provide a clamping force to a roller or plurality of pinch rollers 60. The pinch rollers 60 engage the plurality of rods (not shown) and assist in extracting the rebar or rods from the adjacent tubes 14 (seen in dashed lines in FIG. 3).

As best seen in FIGS. 2 and 3, a series of liquid pumps 62 pump fluid from the kettle 30 into the liquid reservoir 12. The liquid which passes from the liquid reservoir 12 into the tubes and out of the entry and exit openings falls or returns to the kettle 30. Accordingly, the liquid moves in a closed loop system from the kettle 30, to the reservoir, into the tubes, and thereafter back to the kettle.

The inner diameter of each of the tubes 14 is larger than the outer diameter of the rods. Accordingly, rods of various diameters may be processed.

Figure 5A:
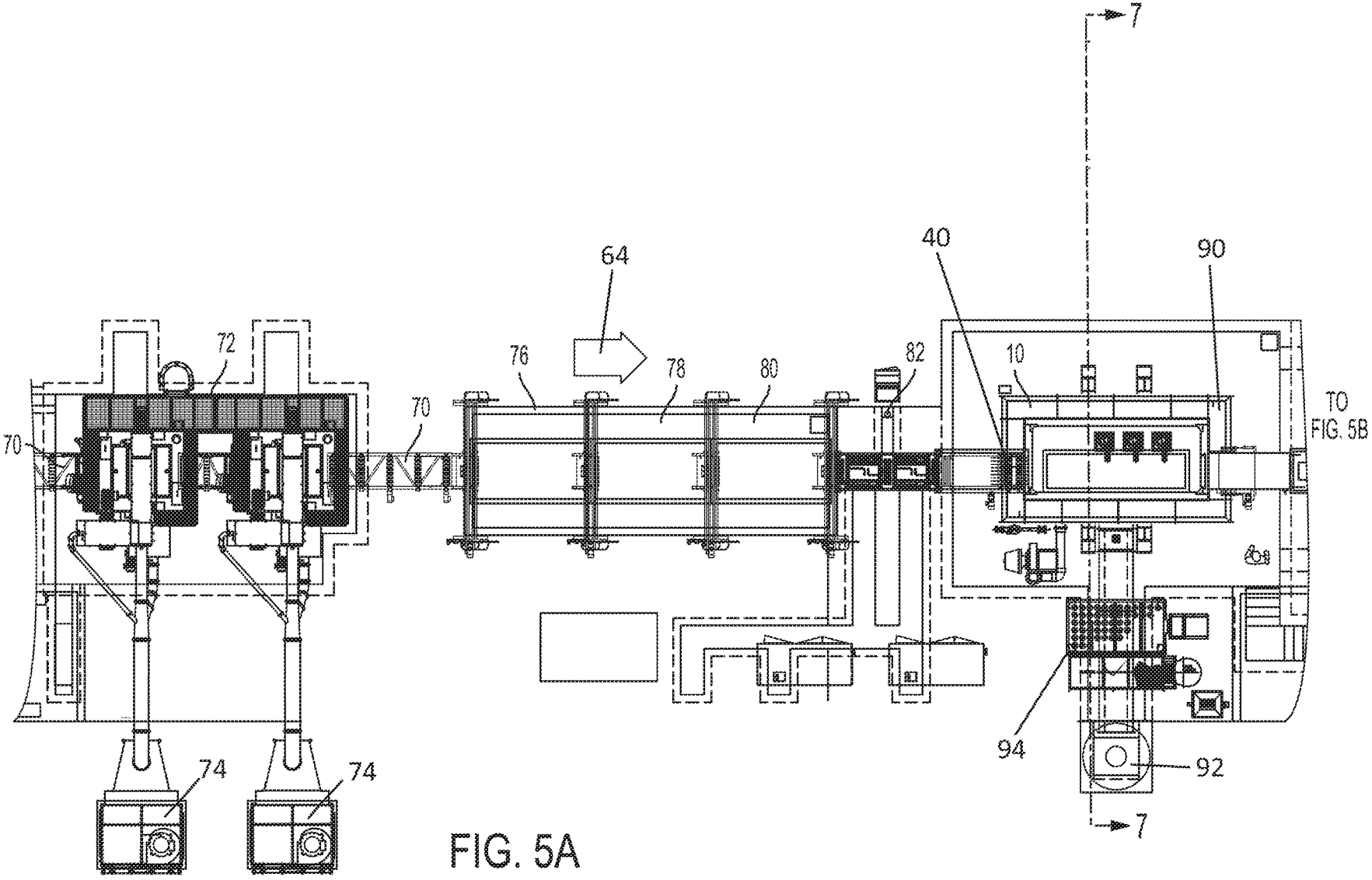
FIGS. 5A and 5B illustrate sequential top views and FIGS. 6A, 6B and 6C illustrate sequential side views of the process of continuous galvanizing.
Figure 5B:
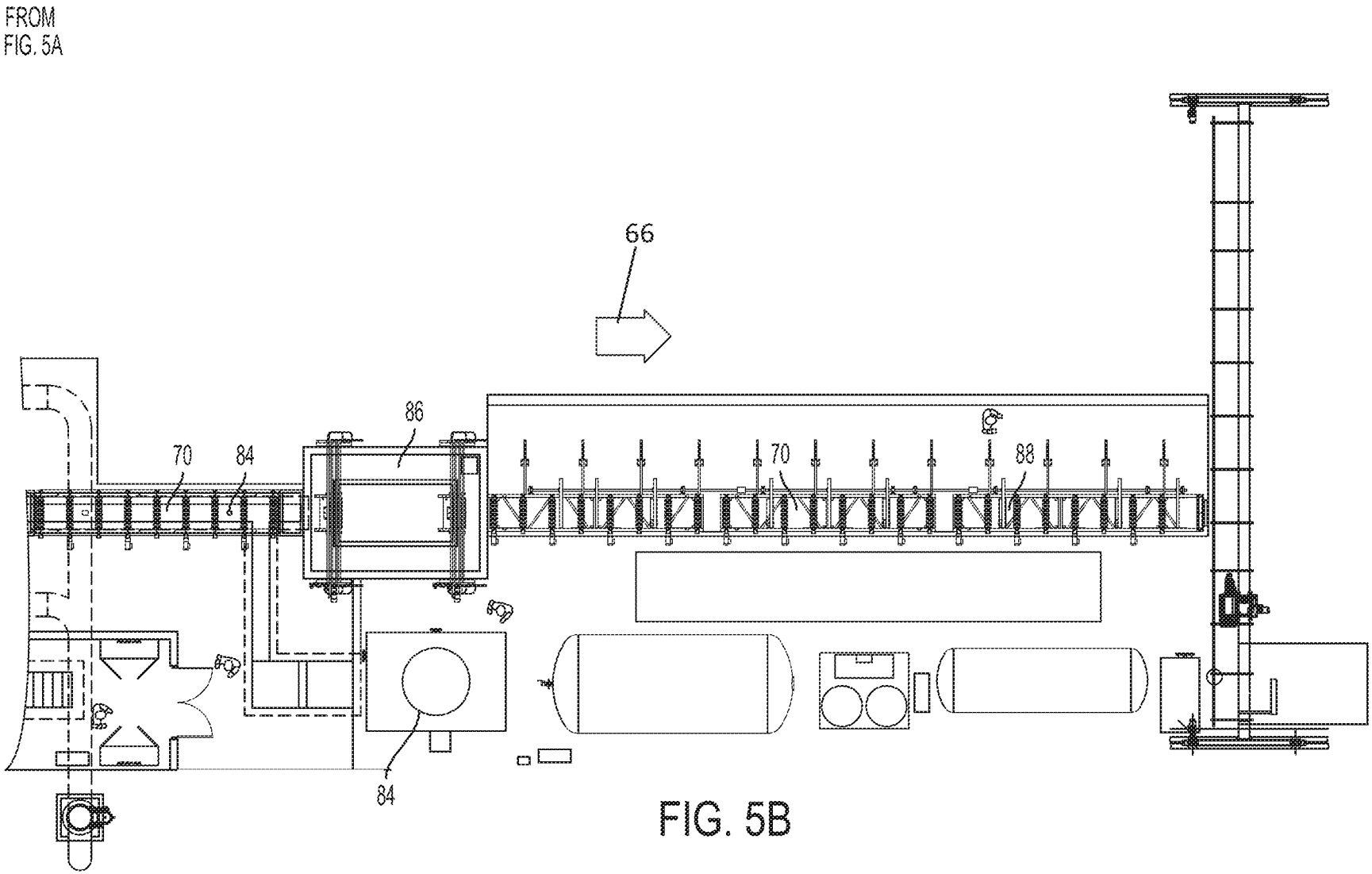
Figure 6A:
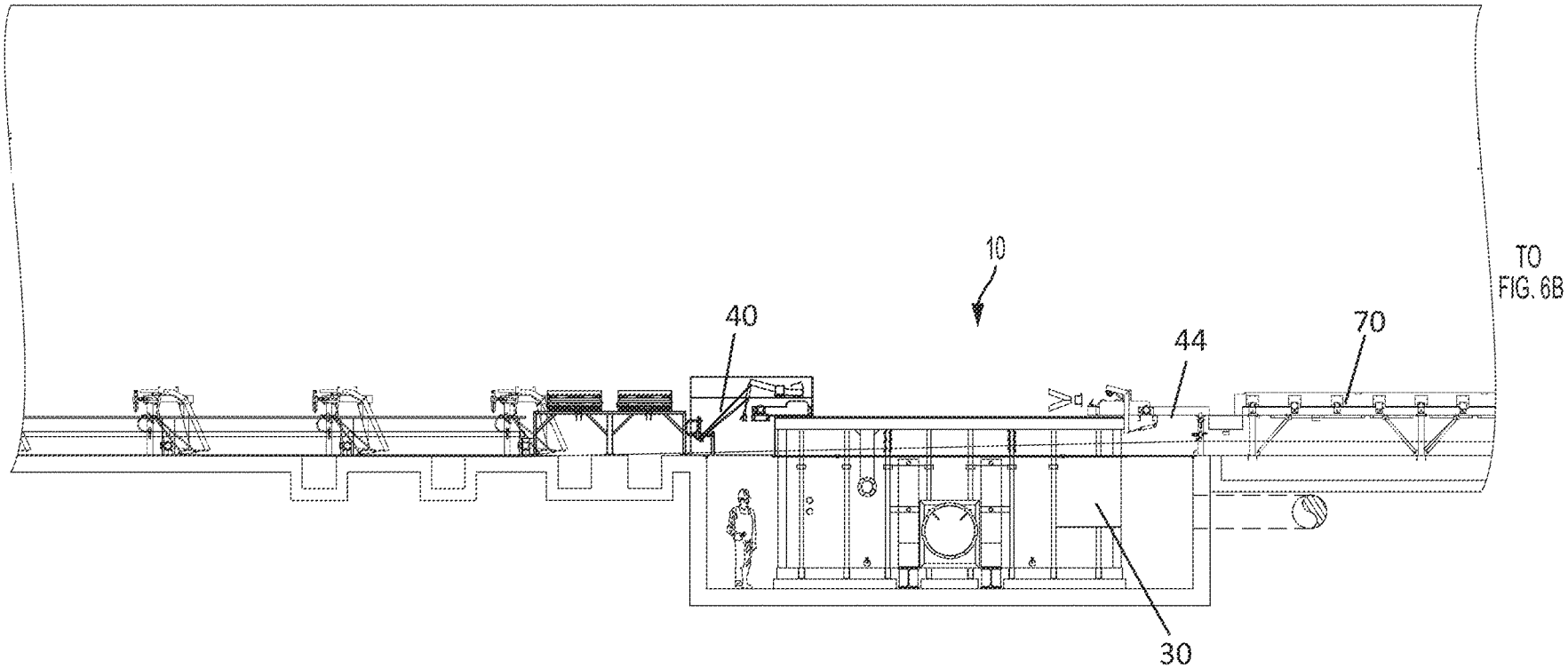
Figure 6B:
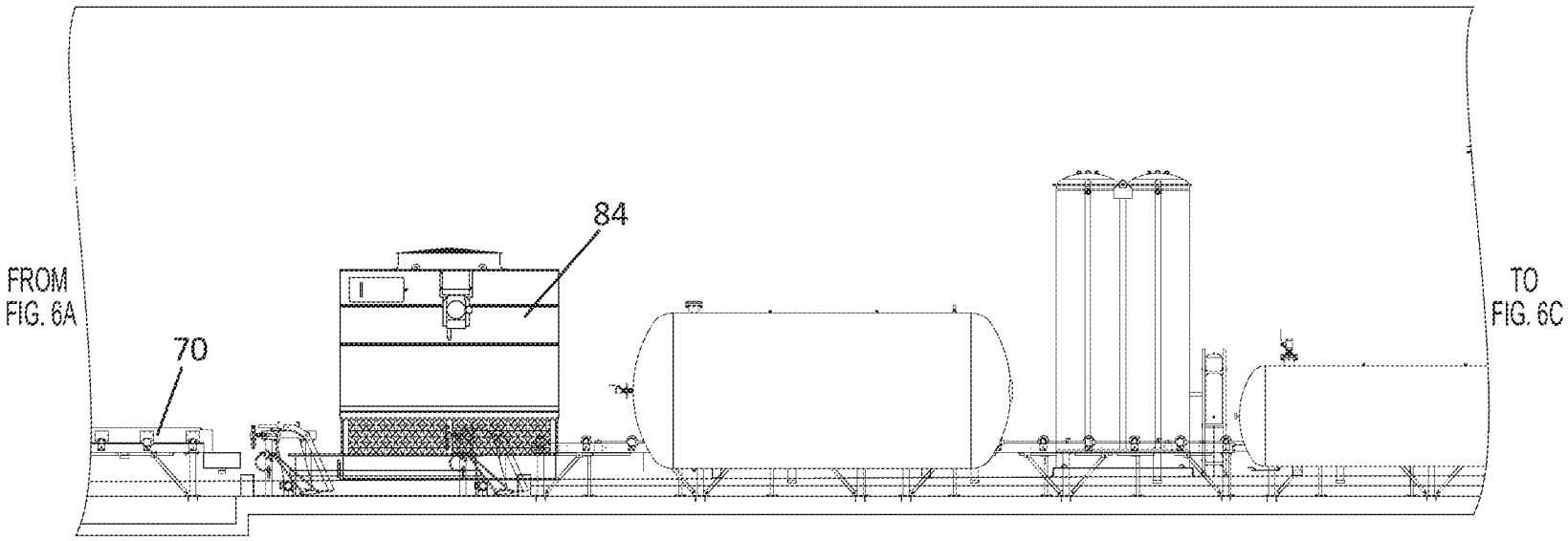
Figure 6C:
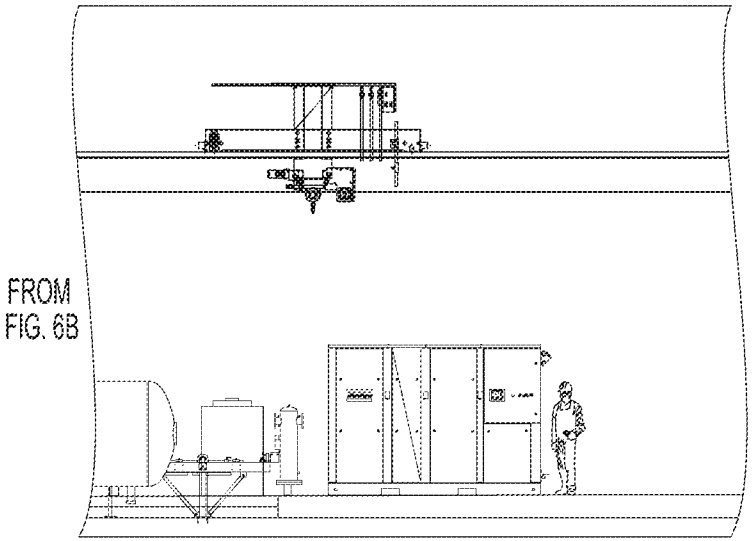

FIGS. 5A and 5B illustrate sequential top views and FIGS. 6A, 6B and 6C illustrate sequential side views of the continuous galvanizing process to simultaneously galvanize a plurality of rods. Arrows 64 and 66 illustrate the direction that the rods move as to proceed through the process.

Initially, a series of rebar or rods are delivered from a supply onto a series of rollers 70. The rollers 70 deliver the rods to a shot blast machine or machines 72. Abrasive media is propelled against the rods under pressure. The shot blast machine 72 physically removes dirt, welding slag and other materials from the surface of the rods. Bead-blasting, sand-blasting or other mechanical mechanisms may be used. The shot blast machine 72 is operated as a continuous process in an enclosure with fans 74 so that the abrasive materials are gathered and then recirculated for use.

Thereafter, the rods are delivered by the rollers 70 to an optional acid wash mechanism 76 where an acidic solution is passed over the adjacent rods. A dilute solution of heated sulfuric acid, hydrochloric acid or other acidic material treats the rods, which acts to remove mill scale and iron oxide, such as rust.

Thereafter, as the rods continue to move by action of the rollers 70, the rods are delivered to a rinse station 78 where the acid material is removed.

Thereafter, the rods are delivered to an optional flux station 80. A zinc ammonium chloride solution is applied to the rods to remove remaining oxides and deposit a protective layer to prevent further oxides from forming.

The rods are thereafter delivered to a pre-heater, such as an induction heater 82 having coils which utilizes electromagnetic induction, which heats the rods prior to galvanization.

Thereafter, the rods are delivered to the continuous galvanizing apparatus 10. The drive mechanism 40 simultaneously inserts the rods into the entry openings 16 of the adjacent tubes 14. Each of the tubes 14 has an inner diameter slightly larger than the exterior diameter of the rods. The adjacent tubes 14 are at least partially filled with the liquid zinc. As the rods pass into and through the tubes, the tubes 14 are substantially filled with the liquid zinc. Each of the rods moves through the liquid reservoir 12. Thereafter, each of the rods moves through the exit opening 18 of the adjacent tubes 14 by action of the rod extracting mechanism 44.

Thereafter, the rods are moved into and through a quench station 84 and a passivation station 86. The rods are cooled by immersion in a passivation solution or water. Finally, the rods are moved to a transfer station 88.

Figure 7:
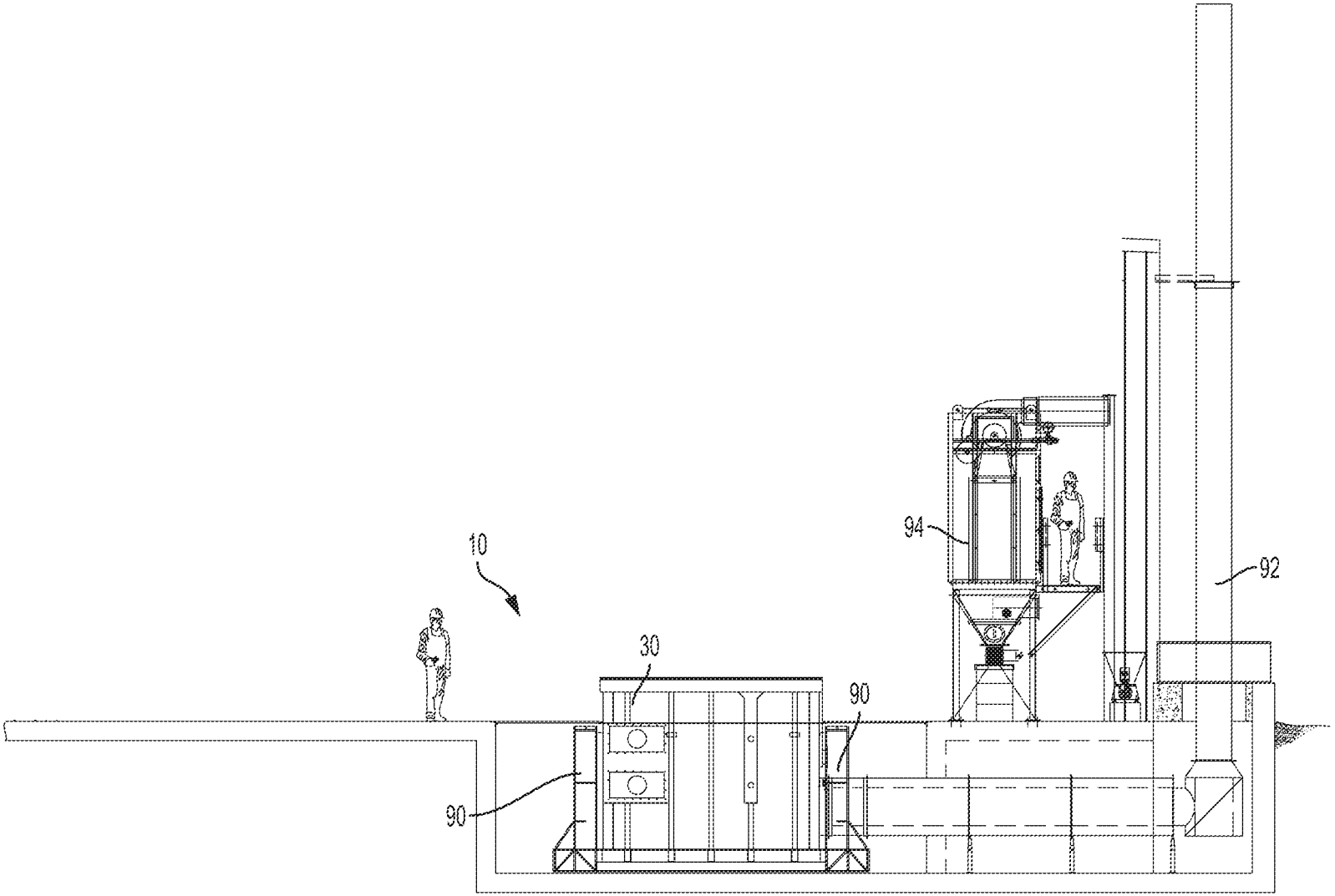
FIG. 7 illustrates a sectional view taken along section line 7-7 of FIG. 5A.

FIG. 7 is a sectional view taken along section line 7-7 of FIG. 5A. As seen in FIG. 5A and in FIG. 7, the apparatus 10 includes a furnace 90 which surrounds the liquid kettle 30. The furnace 90 heats the liquid zinc or zinc and aluminum to a liquid stage. The furnace 90 is vented to the atmosphere by exhaust stack 92. The fume canopy 28 over the kettle 30 also includes air handling equipment 94.

The present invention provides an apparatus and a method for simultaneously galvanizing multiple rods continuously without manual intervention.

Whereas, the invention has been described in relation to the drawings attached hereto, it should be understood that other and further modifications, apart from those shown or suggested herein, may be made within the scope of this invention.

What is claimed is:

1. A continuous process for simultaneously galvanizing a plurality of rods, the process comprising:

simultaneously passing a plurality of adjacent rods of said plurality of rods to a plurality of adjacent tubes, each of said adjacent tubes passing through an elongated liquid reservoir having a closed base, wherein each of said tubes pass in a transverse direction through said elongated reservoir above a level of said closed base, each of said tubes having a series of slots positioned within said liquid reservoir configured to permit passage of liquid from said reservoir to each of said tubes; and simultaneously passing said plurality of adjacent rods into and through said plurality of adjacent tubes, wherein each of said tubes has a cylindrical bore throughout, extending from a cylindrical entry opening, to an opposed cylindrical exit opening, and wherein each of said plurality of adjacent tubes has a length shorter than a length of each of said plurality of rods;

passing said plurality of adjacent rods out of said plurality of tubes;

providing an open kettle beneath said liquid reservoir and beneath said plurality of adjacent tubes, wherein said cylindrical entry opening and said cylindrical exit opening of each tube are above said kettle;

permitting liquid in said plurality of adjacent tubes to fall by gravity from said cylindrical entry openings and said cylindrical exit openings to said liquid kettle; and pumping liquid from said kettle to said liquid reservoir.

2. The continuous galvanizing process as set forth in claim 1 wherein said step of passing said plurality of adjacent rods includes the steps of inserting said plurality of rods into said adjacent tubes with a first motor and a plurality of pinch rollers and extracting said adjacent rods from said plurality of adjacent tubes with a second motor and a plurality of pinch rollers.

3. The continuous galvanizing process as set forth in claim 1 including the additional preliminary steps of:

passing said plurality of adjacent rods simultaneously through an acidic solution; and rinsing said acidic solution from said plurality of adjacent rods.

4. The continuous galvanizing process as set forth in claim 1 including the additional preliminary steps of:

simultaneously passing a plurality of adjacent rods to a flux station; and simultaneously applying liquid flux to the plurality of adjacent rods.

5. The continuous galvanizing process as set forth in claim 1 including the additional subsequent steps of:

passing said plurality of adjacent rods through a quench tank to reduce the temperature of said rods; and passivation quenching of said plurality of adjacent rods.

* * * * *